US007478642B2

(12) United States Patent
Koch et al.

(10) Patent No.: US 7,478,642 B2
(45) Date of Patent: Jan. 20, 2009

(54) DISH BASKET FOR A DISH WASHER

(75) Inventors: Stephan Koch, Detmold (DE); Horst Moeller, Werther (DE); Dirk Wegener, Bielefeld (DE)

(73) Assignee: Miele & Cie. KG., Guetersloh (DE)

( * ) Notice: Subject to any disclaimer, the term of this patent is extended or adjusted under 35 U.S.C. 154(b) by 393 days.

(21) Appl. No.: 11/060,930

(22) Filed: Feb. 18, 2005

(65) Prior Publication Data

US 2005/0178412 A1 Aug. 18, 2005

(30) Foreign Application Priority Data

Feb. 18, 2004 (DE) ..... 10 2004 008 118

(51) Int. Cl.
*B08B 3/02* (2006.01)

(52) U.S. Cl. ..... 134/135; 134/56 D; 211/41.9

(58) Field of Classification Search ..... 134/135
See application file for complete search history.

(56) References Cited

U.S. PATENT DOCUMENTS 2,419,040 A * 4/1947 Stepanian ..... 211/74
3,433,363 A * 3/1969 Clearman et al. ..... 211/41.8
3,647,077 A * 3/1972 Gillespie ..... 211/133.5
4,193,588 A * 3/1980 Doneaux ..... 269/47
4,732,291 A * 3/1988 McConnell ..... 220/488
4,909,401 A * 3/1990 McConnell ..... 211/74
4,969,560 A * 11/1990 Stanfield ..... 211/41.2
5,431,294 A * 7/1995 Stottmann et al. ..... 220/23.4
6,123,204 A * 9/2000 Nelson et al. ..... 211/41.9

FOREIGN PATENT DOCUMENTS

| | | |
|---|---|---|
| DE | 1865994 | 1/1963 |
| DE | 7341834 | 3/1974 |
| DE | 2946591 | 5/1981 |
| EP | 0272795 | 6/1988 |
| EP | 0367559 | 5/1990 |
| EP | 1356761 | 10/2003 |

OTHER PUBLICATIONS

European Search Report for EP1566138 mailed on May 24, 2005.

* cited by examiner

*Primary Examiner*—Michael Barr
*Assistant Examiner*—Jason P Riggleman
(74) *Attorney, Agent, or Firm*—Darby & Darby

(57) ABSTRACT

An insert for use with a dish washer provided with a rotary spray arm having a nozzle therein and with at least one rinsing basket. The insert is provided at least one receptacle for securely supporting a bottle with its opening in alignment with the rotary path of movement of the nozzle. Protrusions are provided in the receptacle for resiliently maintaining a bottle in its position.

7 Claims, 3 Drawing Sheets

DISH BASKET FOR A DISH WASHER

BACKGROUND OF THE INVENTION

1. Field of the Invention

The invention, in general, relates to a dish basket for use in a dish washer and, more particularly, the a dish basket provided with means for positioning different articles to be washed and for maintaining the position during a washing operation.

2. The Prior Art

The prior art is replete with baskets disposed in dish washers for receiving dishes to be cleaned. Such dish or rinsing baskets are provided with receptacles in which differently formed or shaped articles can be maintained so that they may be properly cleaned. A common problem inherent in washing bottles is that no suitable receptacles are provided in the rinsing basket which allow proper washing of bottles, especially baby bottles. To clean such bottles, recourse may be had to a section of the rinsing basket which is normally used for cleaning glasses or stem ware. However, light baby bottles made of plastic cannot be securely held within this section of the rinsing basket. In order nevertheless to secure the bottles, they may be placed on the prongs which can then no longer be used for their intended purpose of supporting plates and the like. To avoid using the prongs and yet secure the bottles, it is known to provide latching bows at the bottom of the rinsing basket. Such latching bows do improve the stability of the bottles; but it has been found that high bottles, especially those with a narrow neck, cannot be thoroughly cleaned and that, moreover, the latching bows cannot secure bottles of every shape. The known brackets do not ensure thorough cleaning of the bottom of bottles so that following a washing operation, contaminants may yet remain in the deepest portion of the bottles.

Reference may be had to German patent specification DE 29 46 591 C2 which discloses a rinsing basket for use in a laboratory. The basket is provided with prongs having spray nozzles so that the washing liquid may be effective within the bottles and especially at the bottom portion thereof. However, the use of such prongs is expensive and suffers from the drawback that neither plates nor cups can be supported by such prongs.

OBJECT OF THE INVENTION

It is, therefore, an object of the invention so to structure a rinsing basket that it makes possible effectively to wash high hollow articles in an optimal fashion.

Other objects will in part be obvious and will in part appear hereinafter.

SUMMARY OF THE INVENTION

In the accomplishment of this and other objects, the invention provides for a rinsing basket for positioning and securing different articles during a washing operation, with a separate insert provided with receptacles for bottles cooperating with, or insertable into, a rinsing basket, the individual receptacles securing a bottle neck or the body of a bottle such that the opening of the bottle is aligned with the spray jet from the spray arm, the separated insert essentially consisting of a basic frame in which the individual bottle receptacles are disposed such that the receptacles are disposed on the circular paths of the nozzles of the spray arm.

The provision of a separate insert for bottles results, in fact, in suitable receptacle for bottles for their effective cleaning in a rinsing basket. The insert is particularly suitable for providing a deposit surface for baby bottles within the area of the rinsing basket which, if desired, may be removed from the rinsing basket. The receptacles are shaped so to secure the neck of body of a bottle that the opening of the bottle constitutes a sufficient target surface for the spray jet from the spray arm.

The preferred positioning of the body of the body enables the jet spray to reach the bottom of the bottle and thus achieve effective cleaning of the bottle especially the deepest portion thereof. In this connection, it is of particular advantage that the receptacles in which the necks of the bottles are retained are disposed on the circular paths of the nozzles of the spray arm. In this manner the jet spray is effective to the bottom of the bottle when it sweeps across the opening of the bottle.

The separate insert essentially consists of a base frame made of bent wire with the individual receptacles for the bottle being disposed therein. The individual receptacles are made up of a receiving ring or receiving sleeve which in the inserted state of a bottle surrounds the neck or body of the bottle. This ensures a secure hold during a washing operation, and it also ensures easy insertion and, after the washing operation, easy withdrawal of the bottle. In an improved embodiment of the invention drain grooves are arranged or formed within the area covered by the ring or sleeve. The drain grooves ensure that not standing water remains within the area in which the ring or sleeve embraces the body of the bottle in order to provide for effective drying of the bottle. In order to provide a secure clamping support of the bottle within the receptacle, supporting tabs are provided within the ring or sleeve which may resiliently engage the body of a bottle.

In one embodiment, the insert advantageously consists, as has been mentioned previously, of a basic frame made of bent wire. The basic frame essentially consists of two parallel arms between which bowed elements are disposed. The bowed elements, in turn, support the receptacles for the bottles. The bride-like bowed elements impart to the basic frame a sufficient inherent stability. The basic frame is structured such that one free end of the arms is bent to form clamping abutments, and the other end of the arms are joined together to form a handle element. The handle is bent, over its extent, in a stepped manner with the terminal section of the handle being formed as latches. It will thus be understood that as a result of the cooperative connection of clamping abutments and latches at the bowed handle, the basic frame forming the insert may be latched into a rinsing basket, in particular the upper rinsing basket. The clamping abutments thus resiliently at one grid-like wall of the rinsing basket, and the bowed handle latching engages the opposite side of the rinsing basket.

The invention also relates to an insert for a rinsing basket or a dish washer which as a separate insert is provided with receptacles for bottles and which cooperates with, or may be inserted into, the rinsing basket of the dish washer. The individual receptacles arrest a bottle neck or body such that the opening of the bottle is aligned with the spray jet of the spray arm or impeller.

A further embodiment of the invention relates to a basket which may be used to provide multiple effects. The basket thus makes it possible not only securely to store and align small pieces within its interior but also large pieces. For this purpose, receptacles for bottles are provided at the nether section of the housing or frame. Brackets for supporting plates may advantageously be provided at the side surfaces of the housing. Hence, the basket does not only provide a secure support for bottles but also for plates which may be supported in an aligned relationship within the brackets. For effectively cleaning bottles receptacles are provided in the lower portion of the housing and are positioned such that they are disposed within the circular paths of the nozzles of the spray arm.

Each bottle receptacle includes an annular opening in the bottom of the housing into which a bottle may be inserted. Thus, when inserted, the body of a bottle is held securely, and the receptacle securely aligns the bottle opening relative to the spray jet thereby ensuring effective cleaning of the bottom of a bottle. Clamping abutments are formed at the circumference of the openings, below the bottom surface. Thus, once a bottle is inserted into the opening the clamping abutments will resiliently engage the outer surface of the bottle or its neck and thus increase its secure hold within the receptacle.

In a particularly advantageous embodiment of the basket, pivotal lids are cooperating with the openings to keep them closed when not in use. In this manner, the insert is provided with a closed bottom surface which allows the placing of small articles into it. The bottom, the lids and the front surfaces of the housing are of a sieve-like structure to provide for an unimpeded flow of liquid into and out of the housing. In an improved embodiment of the housing grip openings are provided in the front and rear surfaces of the housing, one of the front and rear surfaces being of stepped configuration. Advantageously, the housing as well as the lids may be made of injection molded plastic. Annular ribs are preferably arranged on the bottom which extend into the interior of the housing and which at their margins have support abutments pointing into the interior of the rings. The abutments constitute brackets for suction nipples and should also be positioned in the circular paths of the nozzles of the spray arm.

DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DETAILED DESCRIPTION OF THE PREFERRED EMBODIMENTS

Figure 1:
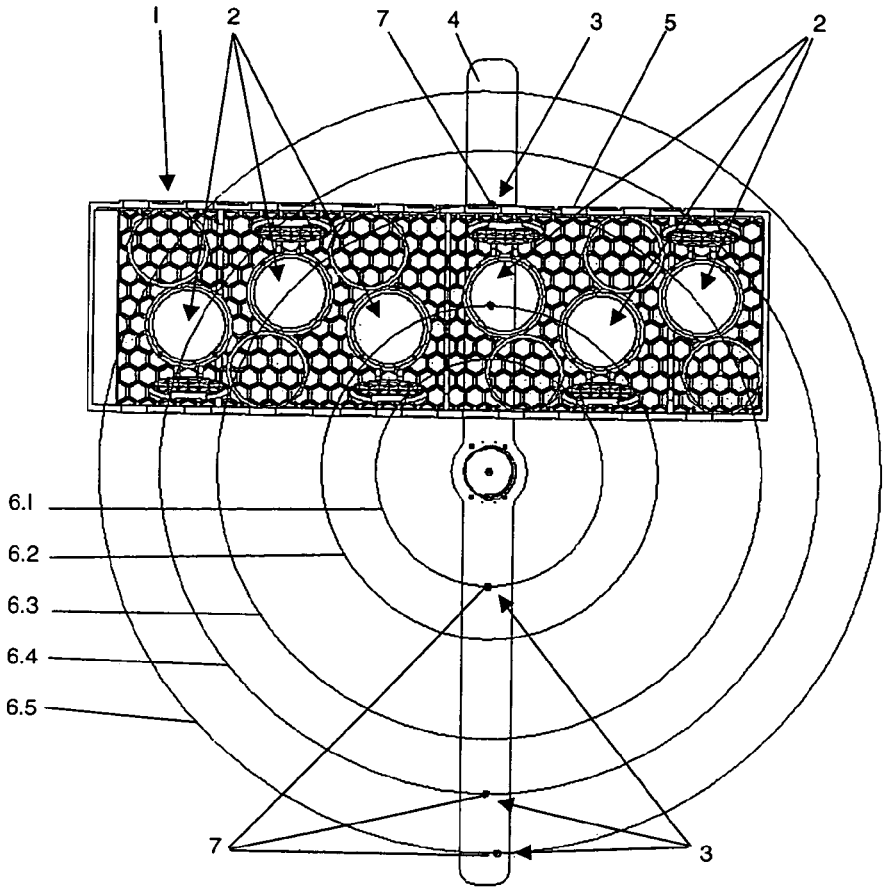
FIG. 1 is a schematic top elevational view of an insert in accordance with the invention in cooperative alignment with the circular paths of the nozzles of a spray arm.
Figure 3:
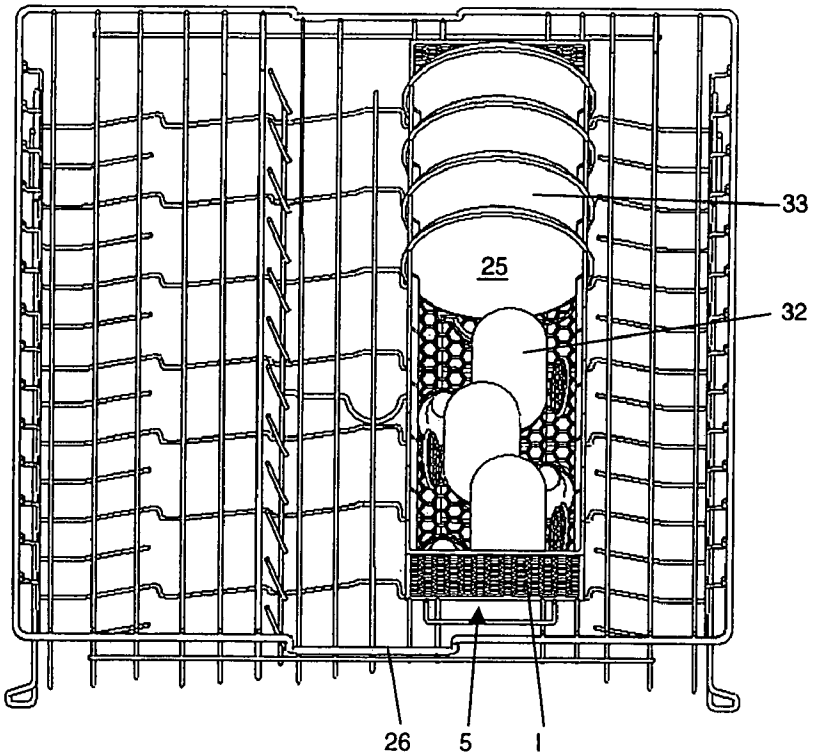
FIG. 3 is a perspective top view of a further embodiment of a insert basket with articles to be washed and inserted in an upper rinsing basket.

FIG. 1 depicts an insert 1 for a rinsing basket 26 of a dish washer. The insert 1 is characterized by being structured as a separate component provided with receptacles 2 for bottles. It will be apparent to those skilled in the art that the insert 1 is adapted to cooperated with a rinsing basket 26 by being placed therein as shown in FIG. 3. The separate insert 1 firmly positions a neck or body of a bottle such that the opening of the bottle is directed to, and aligned with, the spray jet 3 from the spray arm 4. The insert 1 essentially consists of a basic frame 5 in which individual receptacles 2 for bottles are positioned to coincide with the circular paths 6.1, 6.2, 6.3, 6.4 and 6.5 of the nozzles 7 of the spray arm 4.

Figure 2:
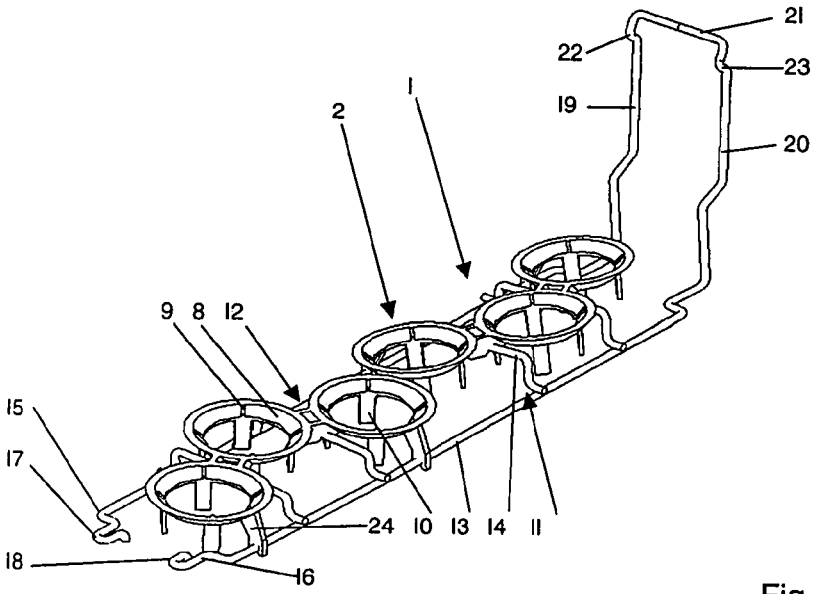
FIG. 2 is a perspective view of an embodiment of an insert in accordance with the invention.

As will be recognized from the perspective view of an embodiment shown in FIG. 2, the separate insert 1 essentially consists of a basic frame 5 in which are positioned individual bottle receptacles 2. An individual receptacle 2 consists of a receiving ring or sleeve 8 which surrounds a bottle neck or body of a bottle when inserted therein. Obviously, when a baby bottle is inserted into the receiving ring or sleeve 8 it will assume a vertical but at any rate upright position within the basic frame 5.

It can be seen in the perspective view that in the area of the ring or sleeve 8 there are provided draining grooves 9 for preventing the formation of standing water, particularly in the area of the ring or sleeve 8, during a washing operation. In the insert direction of a bottle, support abutments 10 are arranged or formed on the ring or sleeve 8, which exert a clamping action on the neck or body of a bottle.

It can also be clearly seen from the perspective view of FIG. 2 that the basic frame 5 forming the insert 1 is made up of a coated wire frame 11 which in essence consists of two arms 12 and 13 extending parallel to each other. Between the arms 12 and 13 there are arranged bridge-like bowed elements 14 which support the bottle receptacles 2. The bowed elements 14 impart a certain inherent stability to the basic frame 5. It can also be seen in FIG. 2 that one free end 15 and 16 of the arms 12 and 13 is bent such that they form clamping protrusions 17 and 18 and that the other ends 19 and 20 of the arms 12 and 13 are joined to form a handle 21.

The handle 21 is arranged such that it extends substantially normal to the direction of the basic frame 5 so that by means of the handle 21 the insert 1 may be handled and clampingly inserted into the upper rinsing basket of a dish washer. For this purpose, the handle 21 is bent in a step-like fashion with latching shoulders 22 and 23 being preferably formed in the terminal portion of the handle 21. The clamping protrusions 17 and 18 and the latching shoulders 22 and 23 make it possible to secure the insert 1 between lateral walls of a rinsing basket to provide a rigid position of the bottle receptacles 2 in the rinsing basket 26. In an advantageous embodiment of the receiving ring or sleeve 8 supportive elements 24 may be provided at their lower surface for mounting on the arms 12 and 13.

FIGS. 3 to 7 show a further embodiment of an insert 1 structured as a basket for receiving and/or supporting different articles 25 to be washed. The insert 1 is of substantially rectangular configuration and may be used, when needed, as a separate component in the rinsing basket of a dish washer 26 for supporting different small articles such as Lego® and similar pieces of toys.

Figure 4:
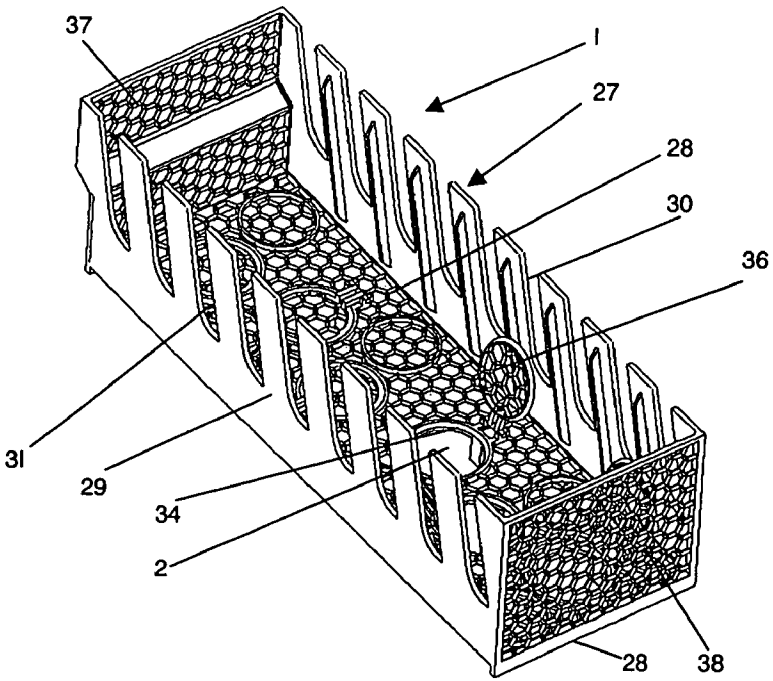
FIG. 4 is an isolated perspective view of the insert basket of FIG. 3.

The insert 1 consists of a housing 27 as clearly shown in the perspective view of FIG. 4. In its area of bottom 28 and side walls 29 the housing 27 is provided with separate receptacles 2 and separate brackets 30 and 31, respectively, for accommodating different types of articles 25 to be washed and which may extend beyond the dimensions of the insert 1. In addition, annular ribs 39 are arranged on the bottom 28 which point into the interior of the housing 27 and which at their margins are provided with supporting abutments 40 extending into the interior of the rings. They serve to receive and securely position suction nipples 41 (see FIG. 7). In order to achieve proper cleaning of the nipples, their brackets are positioned on the circular paths 6.1, 6.2, 6.3, 6.4, 6.5 of the nozzles 7 of the spray arm 4.

As may be seen from the perspective presentation of FIGS. 3 and 4, the housing 27 is structured such that it may receive bottles 32 in its receptacles 2 at the bottom 28. In addition, the side walls 29 of the housing 27 are preferably provided with brackets 30 for plates 33. The brackets 30 are slotted to provide for a substantially upright position of any plates 33.

Figure 5:
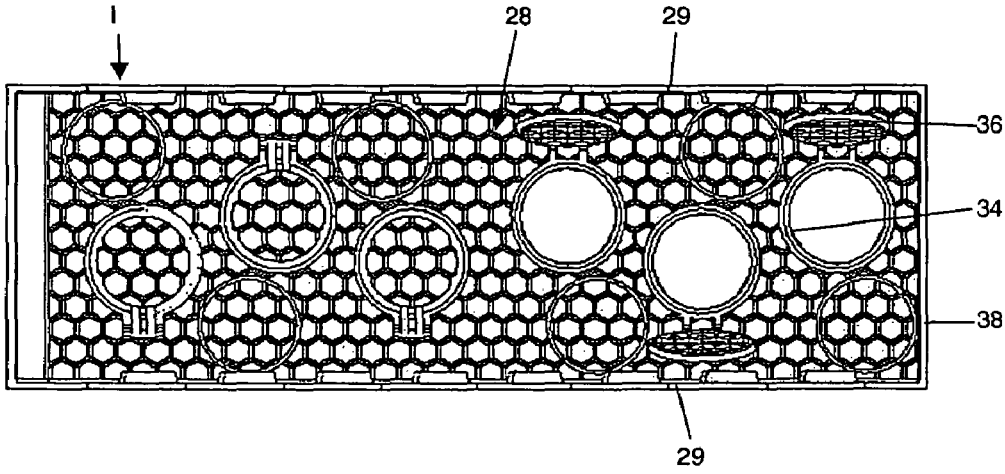
FIG. 5 is a top elevational view of the insert basket of FIG. 3.
Figure 6:
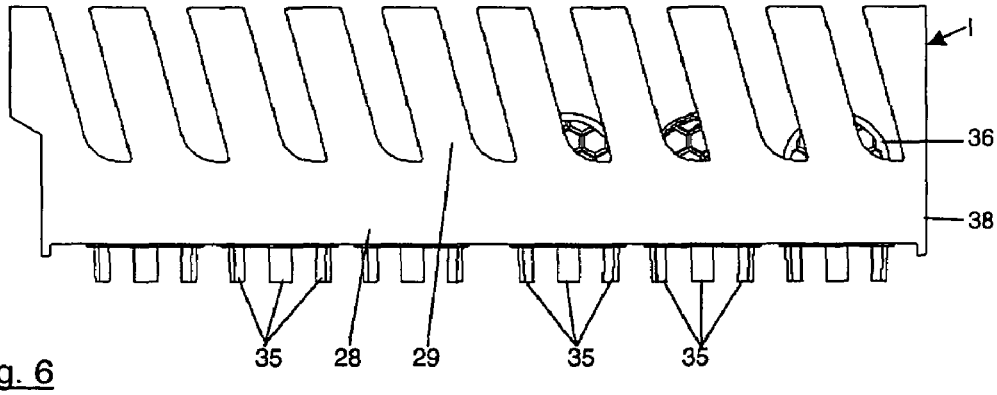
FIG. 6 is a side view of the insert basket of FIG. 3.
Figure 7:
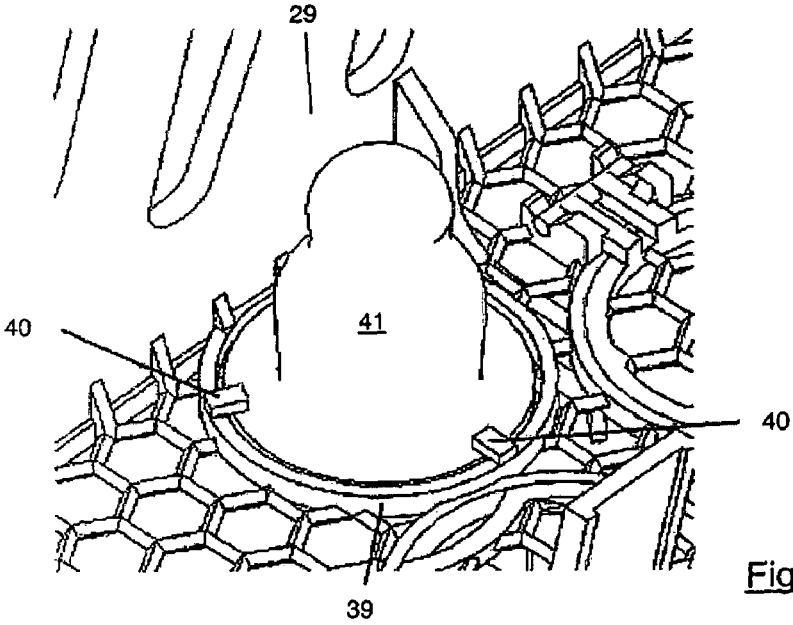
FIG. 7 is a partial view of the insert basket in the area provided with brackets for suction nipples.

FIGS. 4 and 5 show the receptacle 2 for the bottles 32 to be an annular opening 34 in the bottom 28 of the housing 27 into which a bottle 32 (see FIG. 3) may be inserted. As seen in the side view depicted in FIG. 6, clamping abutments 35 are provided at the circumference of the openings 34, below the surface of the bottom.

In accordance with a particularly advantageous embodiment of the invention, pivotal lids 36 are provided for closing the openings 34. Thus it will be understood, that if no bottles are disposed in the insert 1, the bottom surface will be closed by pivoting of the lids 36. The result is a box-like housing 27 in which small articles, for instance children's toys, may be securely placed since the bottom thus constitutes a safe deposit surface.

Looking at FIGS. 3 to 6, it will be seen that the bottom 28, the lids 36 as well as the end surfaces 37 and 38 of the housing 27 are of a sieve-like structure. Grip openings (not shown) may be provided in the front and rear surfaces 37 and 38 to facilitate handling of the housing 27. Moreover, the front surface 37 of the housing 27 may be of stepped configuration.

In order to be able economically to fabricate the insert 1 in accordance with the invention, the housing 27 and the lids 36 are preferably made of injection molded plastic components.

Skilled artisans will understand that the invention also relates to an insert 1 for the rinsing basket of a dish washer.

What is claimed is:

1. A dish washer comprising:

a plurality of nozzles on a nozzle arm, each nozzle configured to move in a respective circular path;

a rinsing basket; and a separate insert engaging or received in the rinsing basket, the separate insert comprising: a housing comprising a bottom wall and side walls, the bottom wall comprising a plurality of receptacles for bottles, each receptacle being aligned with the circular path of one of the plurality of nozzles on the nozzle arm and configured to secure a neck or a body of a respective bottle of the bottles so as to align an opening of the respective bottle with a spray jet of the nozzle arm, and the side walls comprising a plurality of holders, each holder configured to hold a plate extending beyond a dimension of the housing, wherein a respective pivotal lid is provided for each receptacle and is configured to selectively close an opening of the respective receptacle.

2. The dish washer of claim 1, wherein each receptacle comprises an annular opening in the bottom wall of the housing operable to receive the respective bottle.

3. The dish washer of claim 1, wherein each receptacle comprises abutment members extending below a bottom surface of the bottom wall and configured to resiliently engage a bottle.

4. The dish washer of claim 1, wherein end walls of the housing, the bottom wall and the pivotal lids comprise a sieve-like structure for providing unimpeded flow of fluid into and out of the frame.

5. The dish washer of claim 1, wherein the housing and the pivotal lids are made of injection molded plastic parts.

6. The dish washer of claim 1, wherein at least one annular rib is provided on the bottom surface protruding into an interior of the housing and provided at its margins with supporting abutments extending into the interior of the annular rib.

7. The dish washer of claim 6, wherein each of the at least one annular rib is positioned to be aligned with the respective circular path of a respective nozzle of the plurality of nozzles on the nozzle arm.

* * * * *